US009230495B2

(12) United States Patent
Su et al.

(10) Patent No.: US 9,230,495 B2
(45) Date of Patent: Jan. 5, 2016

(54) SELF-DETECTION CHARGE SHARING MODULE

(71) Applicant: NOVATEK Microelectronics Corp., Hsin-Chu (TW)

(72) Inventors: Chia-Wei Su, Hsinchu (TW); Po-Yu Tseng, Taoyuan County (TW); Shun-Hsun Yang, Hsinchu (TW); Po-Hsiang Fang, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 261 days.

(21) Appl. No.: 14/048,013

(22) Filed: Oct. 7, 2013

(65) Prior Publication Data

US 2014/0111494 A1 Apr. 24, 2014

(30) Foreign Application Priority Data

Oct. 23, 2012 (TW) ..... 101139075 A

(51) Int. Cl.
*G09G 3/36* (2006.01)

(52) U.S. Cl.
CPC ..... *G09G 3/3614* (2013.01); *G09G 2310/0248* (2013.01); *G09G 2330/023* (2013.01)

(58) Field of Classification Search
CPC ..... G09G 3/3688; G09G 3/3614; G09G 2330/023; G09G 2330/045; G09G 2330/021; G09G 2310/0254; G09G 2310/0251; G09G 2310/0248; G09G 2310/027; G09G 2310/0256; G09G 2320/0252
See application file for complete search history.

(56) References Cited

U.S. PATENT DOCUMENTS

| | | | | |
|---|---|---|---|---|
| 6,329,974 | B1 * | 12/2001 | Walker et al. | 345/98 |
| 2006/0001630 | A1 * | 1/2006 | Chen et al. | 345/96 |
| 2006/0262069 | A1 * | 11/2006 | Do et al. | 345/98 |
| 2007/0229485 | A1 * | 10/2007 | Burr et al. | 345/211 |
| 2007/0290979 | A1 * | 12/2007 | Lee et al. | 345/100 |
| 2009/0231253 | A1 * | 9/2009 | Hu | 345/87 |
| 2010/0188389 | A1 * | 7/2010 | Hsu et al. | 345/212 |
| 2011/0018853 | A1 * | 1/2011 | Kawagoshi | 345/211 |
| 2011/0050677 | A1 * | 3/2011 | Tsai et al. | 345/213 |
| 2011/0164006 | A1 * | 7/2011 | Son et al. | 345/204 |
| 2013/0127806 | A1 * | 5/2013 | Wu et al. | 345/211 |

(Continued)

FOREIGN PATENT DOCUMENTS

| | | |
|---|---|---|
| CN | 102262850 A | 11/2011 |
| TW | 201017611 | 5/2010 |

(Continued)

*Primary Examiner* — Priyank Shah
(74) *Attorney, Agent, or Firm* — Winston Hsu; Scott Margo

(57) ABSTRACT

A self-detection charge sharing module for a liquid crystal display device is disclosed. The self-detection charge sharing module includes at least one detecting unit, for detecting a plurality of input voltages of a plurality of operational amplifiers driving a plurality of data line sand a plurality of output voltage of the plurality of data line, to generate at least one detecting result, and at least one charge sharing unit, for conducting connection between at least one first data line and at least one second data line among the plurality of data line when the at least one detecting result indicates at least one corresponding first input voltage and at least one corresponding second input voltage among the plurality of input voltage have opposite voltage variation direction and vary toward each other. The at least one first input voltage and the at least one second input voltage maintain respective polarities.

22 Claims, 9 Drawing Sheets

(56) References Cited

U.S. PATENT DOCUMENTS

| | | | | |
|---|---|---|---|---|
| 2014/0232627 | A1* | 8/2014 | Chen et al. | 345/96 |
| 2015/0042629 | A1* | 2/2015 | Hung et al. | 345/209 |

FOREIGN PATENT DOCUMENTS

| | | |
|---|---|---|
| TW | 201028988 | 8/2010 |
| TW | 201207802 | 2/2012 |

* cited by examiner

SELF-DETECTION CHARGE SHARING MODULE

BACKGROUND OF THE INVENTION

1. Field of the Invention

The present invention relates to a self-detection charge sharing module, and more particularly, to a self-detection charge sharing module capable of detecting tendency of voltage variation of data lines and performing charge sharing, to raise performance of power saving.

2. Description of the Prior Art

The advantages of a liquid crystal display (LCD) include lighter weight, less electrical consumption, and less radiation contamination as compared to other conventional displays. Thus, LCD devices have been widely applied to various portable information products, such as notebooks, PDAs, etc. In an LCD device, incident lights are polarized or refracted differently when the alignment of liquid crystal molecules is altered. The transmission of the incident light is affected by the liquid crystal molecules, and thus magnitude of the light emitting out of the liquid crystal molecules varies. The LCD device utilizes the characteristics of the liquid crystal molecules to control the corresponding light transmittance and produces gorgeous images according to different intensities and gray scales of red, blue, and green light.

Please refer to FIG. 1, which illustrates a schematic diagram of a conventional thin film transistor (TFT) LCD device 10. The LCD device 10 includes an LCD panel 100, a timing controller 102, a source driver 104, and a gate driver 106. The LCD panel 100 includes two parallel substrates, and the liquid crystal molecules are filled up between these two substrates. A plurality of data lines 110, a plurality of scan lines 112 perpendicular to the data lines 110, and a plurality of TFTs 114 are disposed on one of the substrates. There is a common electrode installed on another substrate for outputting a common voltage Vcom via the common electrode. Please note that only four TFTs 114 are shown in FIG. 1 for simplicity of illustration. In practical implementation, the LCD panel 100 has one TFT 114 installed in each intersection of the data lines 110 and scan lines 112. In other words, the TFTs 114 are arranged in a matrix form on the LCD panel 100. The respective data lines 110 correspond to different columns, and the respective scan lines 112 correspond to different rows. The LCD device 10 uses a specific column and a specific row to locate the associated TFT 114 that corresponds to a pixel. In addition, the two parallel substrates of the LCD panel 100 filled up with liquid crystal molecules can be considered as an equivalent capacitor 116.

The operation of the conventional LCD device 10 is described as follows. First, the timing controller 102 generates data signals for image display as well as control signals and timing signals for driving the control panel 100. The source driver 104 and the gate driver 106 generate input signals for different data lines 110 and scan lines 112 according to the signals sent by the timing controller 102, to control conduction of the corresponding TFTs 114 and voltage differences across the equivalent capacitors 116, so as to change the alignment of liquid crystal molecules and light transmittance. For example, the gate driver 106 outputs a pulse to the scan line 112 for turning on the TFT 114. Therefore, the voltage of the input signal generated by the source driver 104 is inputted into the equivalent capacitor 116 through the data line 110 and the TFT 114. The voltage difference kept by the equivalent capacitor 116 can then adjust a corresponding gray level of the related pixel through affecting the related alignment of liquid crystal molecules positioned between the two parallel substrates. In addition, the source driver 104 generates the input signals, and magnitude of each input signal inputted to the data line 110 corresponds to different gray levels.

If the LCD device 10 continuously uses a positive voltage to drive the liquid crystal molecules, the liquid crystal molecules will not quickly change a corresponding alignment according to the applied voltages. Similarly, if the LCD device 10 continuously uses a negative voltage to drive the liquid crystal molecules, the liquid crystal molecules will not quickly change a corresponding alignment according to the applied voltages. Thus, the incident light will not produce accurate polarization or refraction, and the quality of images displayed on the LCD device 10 deteriorates. In order to protect the liquid crystal molecules from being irregular, the LCD device 10 must alternately use positive and negative voltages to drive the liquid crystal molecules. In addition, the LCD panel 100 has the equivalent capacitors 116, and the related circuit also has some parasitic capacitors owing to its intrinsic structure. When the same image is displayed on the LCD panel 100 for a long time, the parasite capacitors will be charged to generate a residual image effect. The residual image with regard to the parasitic capacitors will further distort the following images displayed on the same LCD panel 100. Therefore, the LCD device 10 must alternately use the positive and the negative voltages to drive the liquid crystal molecules for eliminating the undesired residual image effect, for example column inversion and dot inversion schemes are exploited.

As mentioned above, when the driving voltages of the LCD panel 100 begin to reverse polarities, the LCD device 10 has the largest loading since the source driver 104 consumes the largest amount of current at this time. Generally, charge sharing is exploited to reuse electrical charges and reduce the reaction time that the equivalent capacitors 116 are charged to the expected voltage level, to save power. In the LCD device 10, the source driver 104 evenly allocates electrical charges by controlling transistor switches between two adjacent data lines to achieve charge sharing.

Please refer to FIG. 2, which is a schematic diagram of voltage levels of an odd data channel CH_ODD and an even data channel CH_EVEN next to the odd channel CH_ODD when the LCD 10 is driven by the dot inversion driving approach. As shown in FIG. 2, the X-axis represents time and the Y-axis represents voltage level. The maximum and minimum driving voltage outputted to the equivalent capacitors 116 can be represented by VDD and VGND. The voltage level after charge sharing can be represented by Vavg. If the liquid crystal molecules are driven in the positive polarity, a driving voltage Vp outputted to the equivalent capacitors 116 needs to be between the common voltage Vcom and the maximum driving voltage VDD. On the other hand, if the liquid crystal molecules are driven in the negative polarity, a driving voltage Vn outputted to the equivalent capacitors 116 needs to be between the minimum driving voltage VGND and the common voltage Vcom.

If the LCD panel 100 of the LCD device 10 is driven by the dot inversion driving approach, as shown in FIG. 2, when a driving period ends, the voltage level of the equivalent capacitor of an odd data channel CH_ODD is equal to the maximum driving voltage VDD, and the voltage level of the equivalent capacitor 116 of an even data channel CH_EVEN is equal to the minimum driving voltage VGND, wherein Vcom=0.5 VDD, and VGND=0. Before the next driving period starts, the conventional LCD device 10 first turns on transistor switches coupled between two adjacent data channels to perform charge sharing and neutralize electrical charges stored in liquid crystal capacitors in the end of the previous driving period. Thus, the voltage level of the equivalent capacitor of the odd data channel CH_ODD is pulled from Vp to Vavg. Similarly, the voltage level of the equivalent capacitor of the even data channel CH_EVEN is pulled from Vn to Vavg. Assuming Vp and Vn are equal to the maximum and minimum driving voltage, respectively, Vag=Vcom=0.5 VDD. During the next driving period, the polarity of the odd data channel CH_ODD turns from positive to negative. Since the source driver 102 discharges the odd data channel CH_ODD in advance through charge sharing, only a voltage difference $\Delta V=-0.5$ VDD is provided for driving the liquid crystal molecules to control the gray levels of the relative pixels. Similarly, during the next driving period, the polarity of the even data channel CH_EVEN turns from negative to positive. Since the source driver 102 charges the even data channel CH_EVEN in advance through charge sharing, only a voltage difference $\Delta V=-0.5$ VDD is provided for driving the liquid crystal molecules to control the gray levels of the relative pixels.

However, in the prior art, conventional charge sharing techniques utilize digital signals (i.e. polarity inverted signals) to control data lines with opposite polarities of voltage to perform charge sharing for power saving when polarities of voltages are inverted. These methods of charge sharing can save power only when polarities of voltages are inverted and thus can not apply to applications of only magnitudes of voltages being changed and polarities of voltages being the same, to perform charge sharing for saving power. Thus, there is a need to improve over the prior art.

SUMMARY OF THE INVENTION

It is therefore an objective of the present invention to provide a self-detection charge sharing module capable of detecting tendency of voltage variation of data lines by itself and performing charge sharing, to raise performance of power saving.

The present invention discloses a self-detection charge sharing module. The self-detection charge sharing module comprises at least one detecting unit, for detecting a plurality of input voltages of a plurality of operational amplifiers driving a plurality of data lines and a plurality of output voltages of the plurality of data lines, to generate a plurality of detecting results; and at least one charge sharing unit, for conducting connection between at least one corresponding first data line and at least one corresponding second data line among the plurality of data line when the plurality of detecting results indicate at least one first input voltage and at least one second input voltage among the plurality of input voltage have opposite voltage variation directions and vary toward each other; wherein the at least one first input voltage and the at least one second input voltage maintain respective polarities.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
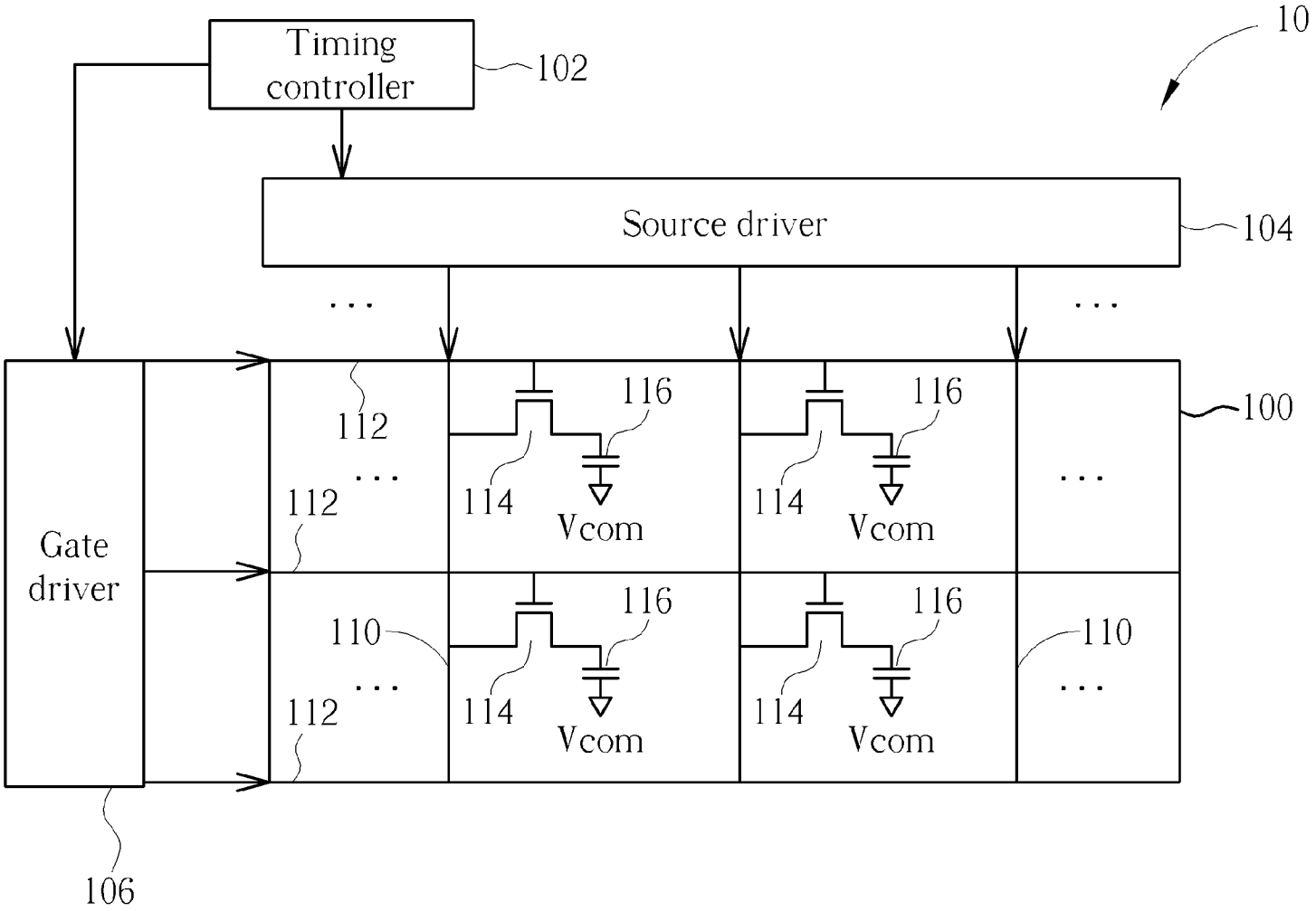
FIG. 1 PRIOR ART
FIG. 1 is a schematic diagram of a prior art thin film transistor LCD device.
Figure 2:
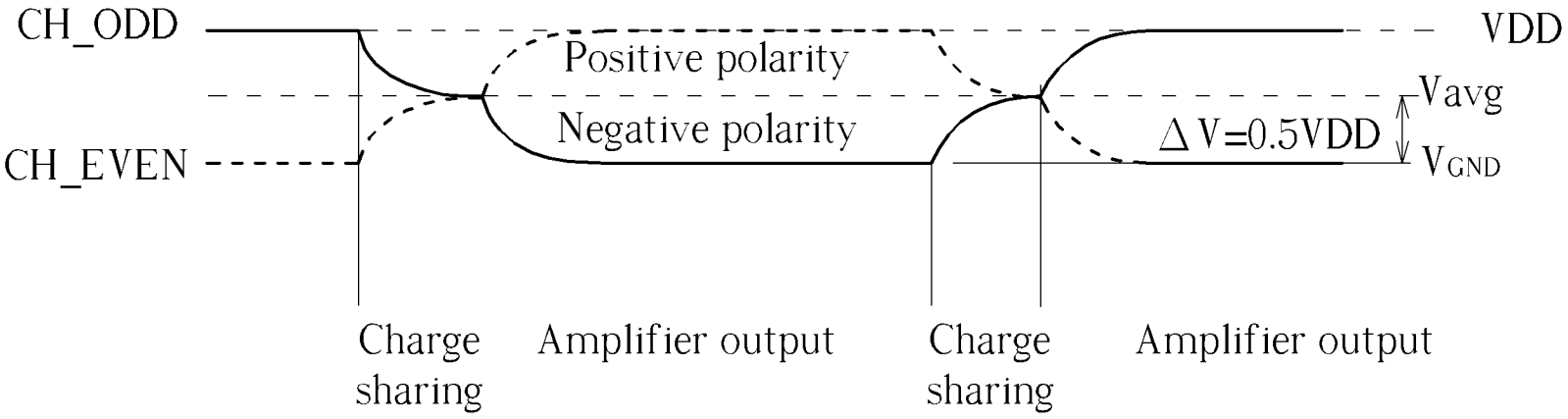
FIG. 2 PRIOR ART
FIG. 2 is a schematic diagram of voltage levels of an odd data channel and an even data channel next to the odd channel when an LCD is driven by the dot inversion driving approach according to the prior art.
Figure 3:
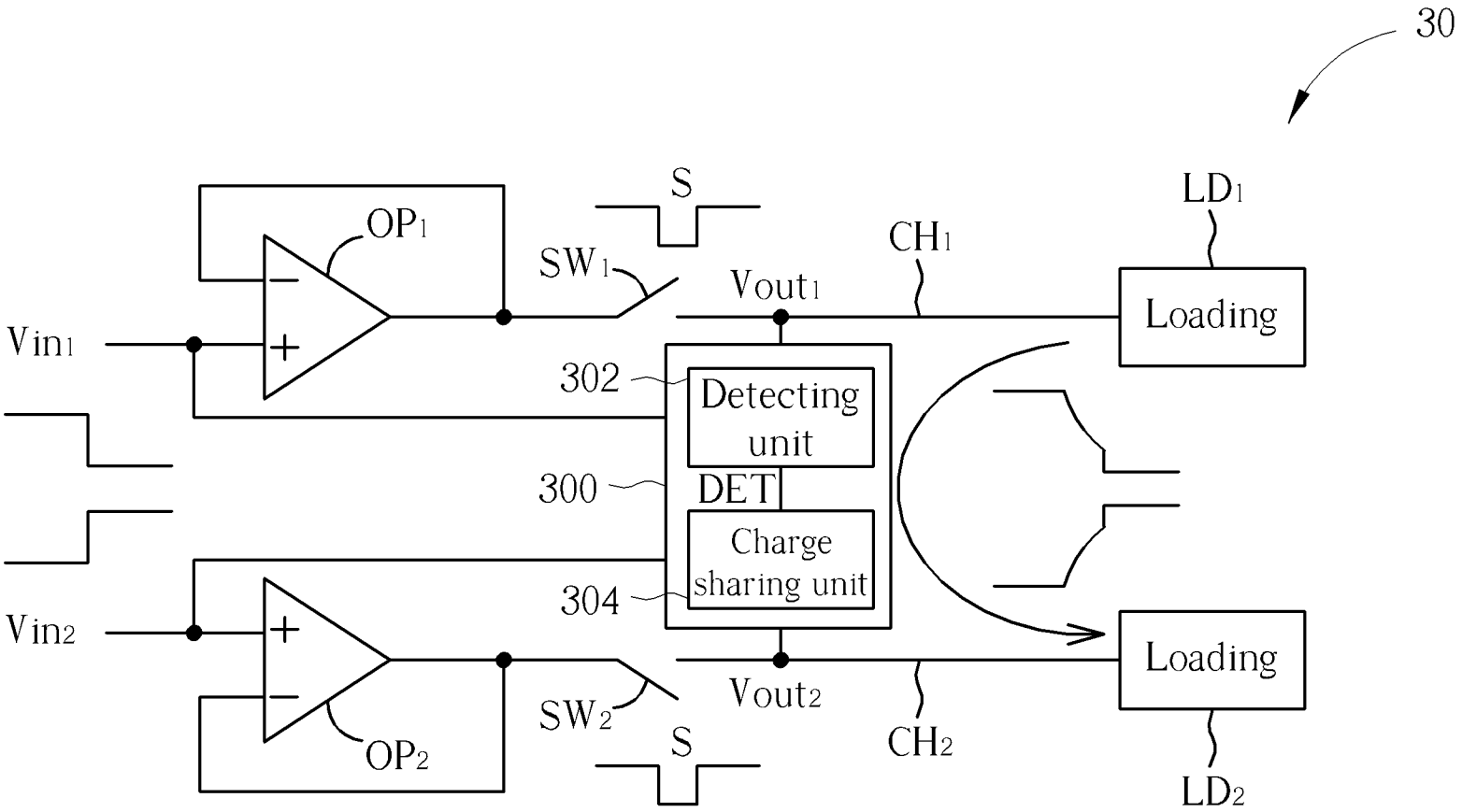
FIG. 3 is a schematic diagram of a liquid crystal display device according to an embodiment of the present invention.

Please refer to FIG. 3. FIG. 3 is a schematic diagram of a liquid crystal display device 30 according to an embodiment of the present invention. As shown in FIG. 3, the liquid crystal display device 30 includes operational amplifiers $OP_1$, $OP_2$, switches $SW_1$, $SW_2$, data lines $CH_1$, $CH_2$, loadings $LD_1$, $LD_2$, a self-detection charge sharing module 300, wherein the self-detection charge sharing module 300 includes a detecting unit 302 and a charge sharing unit 304. In short, output terminals of the operational amplifiers $OP_1$, $OP_2$ are coupled to negative input terminals of the operational amplifiers $OP_1$, $OP_2$ to form negative feedback structures. Therefore, voltages of output terminals can be locked at input voltages $Vin_1$, $Vin_2$ received by positive input terminals, to drive the data lines $CH_1$, $CH_2$ to raise output voltages $Vout_1$, $Vout_2$ outputted to the loadings $LD_1$, $LD_2$ to same voltage levels of the input voltages $Vin_1$, $Vin_2$ when the switches $SW_1$, $SW_2$ is conducted according to a control signal S.

Under such a structure, the detecting unit 302 detects the input voltages $Vin_1$, $Vin_2$ of the operational amplifiers $OP_1$, $OP_2$ driving the data lines $CH_1$, $CH_2$ and the output voltages $Vout_1$, $Vout_2$ of the data lines $CH_1$, $CH_2$, to generate a detecting result DET for the charge sharing unit 304, such that the charge sharing unit 304 conducts a connection between the data lines $CH_1$ and $CH_2$, to share charges of the loadings $LD_1$, $LD_2$ when the detecting result DET indicates the input voltage $Vin_1$ and the input voltage $Vin_2$ have opposite voltage variation directions and vary toward each other. Under such a situation, the self-detection charge sharing module 300 can perform charge sharing when polarities of the input voltages $Vin_1$, $Vin_2$ are inverted, like conventional charge sharing techniques, and can also perform charge sharing when the input voltages $Vin_1$, $Vin_2$ change and still maintain respective same polarities. As a result, the present invention can self-detect tendency of voltage variation of the data lines $CH_1$, $CH_2$ and perform charge sharing, to enhance performance of power saving.

Figure 4:
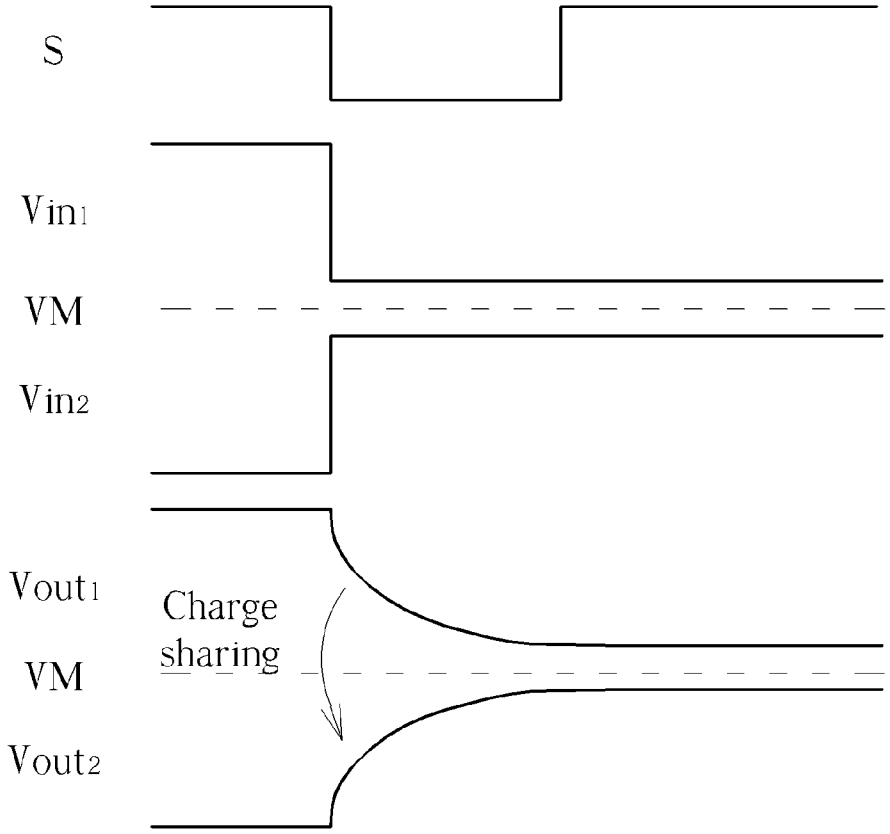
FIG. 4 is a schematic diagram of the liquid crystal display device in FIG. 3 performing charge sharing when polarities of input voltages are opposite and the input voltages Vary toward a middle voltage.

In detail, please refer to FIG. 4. FIG. 4 is a schematic diagram of the liquid crystal display device 30 in FIG. 3 performing charge sharing when polarities of the input voltages $Vin_1$-$Vin_2$ are opposite and the input voltages $Vin_1$-$Vin_2$ vary toward a middle voltage VM. As shown in FIG. 4, when the input voltage $Vin_1$ varies from a high voltage level to the middle voltage VM (varies toward negative direction), and the input voltage $Vin_2$ varies from a low voltage level to the middle voltage VM (varies toward positive direction), such that the input voltages $Vin_1$, $Vin_2$ vary toward each other (the polarity of the input voltage $Vin_1$ is positive and the polarity of the input voltage $Vin_2$ is negative, i.e. the data lines $CH_1$, $CH_2$ are adjacent data lines or one is an odd data line and another one is an even data line), the control signal S indicates the switches $SW_1$, $SW_2$ to disconnect connections between the operational amplifiers $OP_1$, $OP_2$ and the data lines $CH_1$, $CH_2$, and then the self-detection charge sharing module 300 conducts the connection between the data lines $CH_1$ and $CH_2$, to share charges of the loadings $LD_1$, $LD_2$. Therefore, the output voltages $Vout_1$, $Vout_2$ vary toward the middle voltage VM through charge sharing and then the control signal S indicates the switches $SW_1$, $SW_2$ to conduct the connections between the operational amplifiers $OP_1$, $OP_2$ and the data lines $CH_1$, $CH_2$ respectively, to drive the output voltages $Vout_1$, $Vout_2$ to the same voltage level of the input voltages $Vin_1$, $Vin_2$. As a result, the present invention can perform charge sharing when the polarities of the input voltages $Vin_1$-$Vin_2$ are opposite and the input voltages $Vin_1$-$Vin_2$ vary toward a middle voltage VM (the input voltages $Vin_1$-$Vin_2$ still maintain original polarities respectively), to raise performance of power saving.

Figure 5:
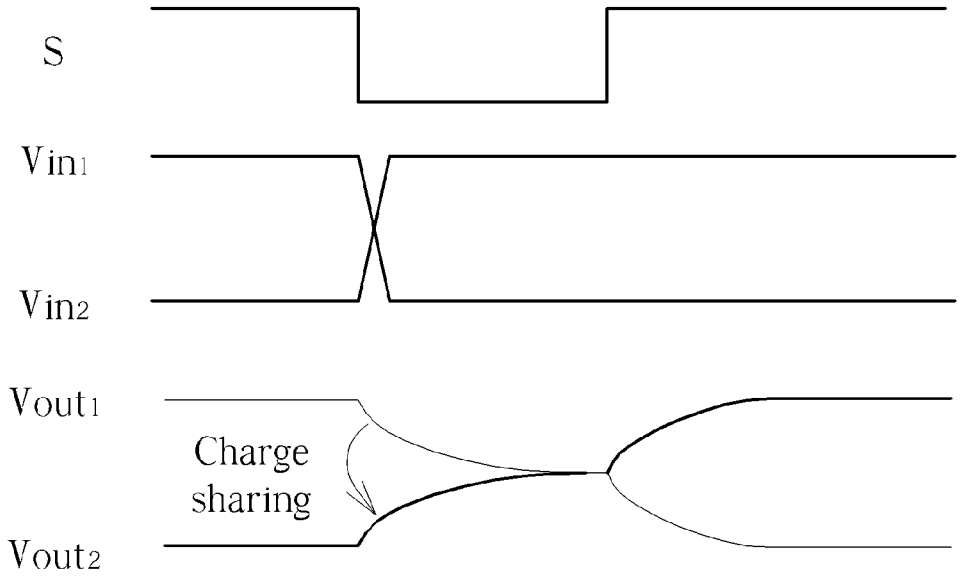
FIG. 5 is a schematic diagram of the liquid crystal display device performing charge sharing in FIG. 3 when polarities of input voltages are the same and the input voltages Vary toward different directions.

On the other hand, please refer to FIG. 5. FIG. 5 is a schematic diagram of the liquid crystal display device 30 performing charge sharing in FIG. 3 when polarities of the input voltages $Vin_1$-$Vin_2$ are the same and the input voltages $Vin_1$-$Vin_2$ vary toward different directions. As shown in FIG. 5, when the input voltage $Vin_1$ varies from the high voltage level to the low voltage level (varies toward negative direction), and the input voltage $Vin_2$ varies from the low voltage level to the high voltage level (varies toward positive direction), such that the input voltages $Vin_1$, $Vin_2$ vary toward each other and then reach target voltage level respectively (the polarities of the input voltages $Vin_1$, $Vin_2$ are both positive or negative, i.e. the data lines $CH_1$, $CH_2$ are separated data lines, e.g. the data lines $CH_1$, $CH_2$ are both odd or even data lines), the control signal S indicates the switches $SW_1$, $SW_2$ to disconnect the connections between the operational amplifiers $OP_1$, $OP_2$ and the data lines $CH_1$, $CH_2$, and then the self-detection charge sharing module 300 conducts the connection between the data lines $CH_1$ and $CH_2$, to share charges of the loadings $LD_1$, $LD_2$. The output voltages $Vout_1$, $Vout_2$ reach a stable voltage through charge sharing and then the control signal S indicates the switches $SW_1$, $SW_2$ to conduct the connections between the operational amplifiers $OP_1$, $OP_2$ and the data lines $CH_1$, $CH_2$ respectively, to drive the output voltages $Vout_1$, $Vout_2$ to the same voltage levels of the input voltages $Vin_1$, $Vin_2$. As a result, the present invention can perform charge sharing when the polarities of the input voltages $Vin_1$-$Vin_2$ are the same and the input voltages $Vin_1$-$Vin_2$ vary different directions (the input voltages $Vin_1$-$Vin_2$ still maintain original polarities respectively), to raise performance of power saving.

Noticeably, the spirit of the present invention is self-detecting tendency of voltage variation of data lines and performing charge sharing, such that charge sharing can be performed when polarities of input voltages are inverted, and charge sharing can also be performed when the input voltages Vary and still maintain same polarities. Those skilled in the art should make modifications or alterations accordingly. For example, as shown in FIG. 3, the self-detection charge sharing module 300 detects the input voltages $Vin_1$, $Vin_2$ and the output voltages $Vout_1$, $Vout_2$ corresponding to the data lines $CH_1$, $CH_2$ to decide whether to perform charge sharing. However, in other embodiments, the self-detection charge sharing module 300 can also detect a plurality of input voltages and output voltages corresponding to a plurality of data lines and data lines to perform charge sharing among the plurality of data lines share charges of through a common bus.

Figure 6:
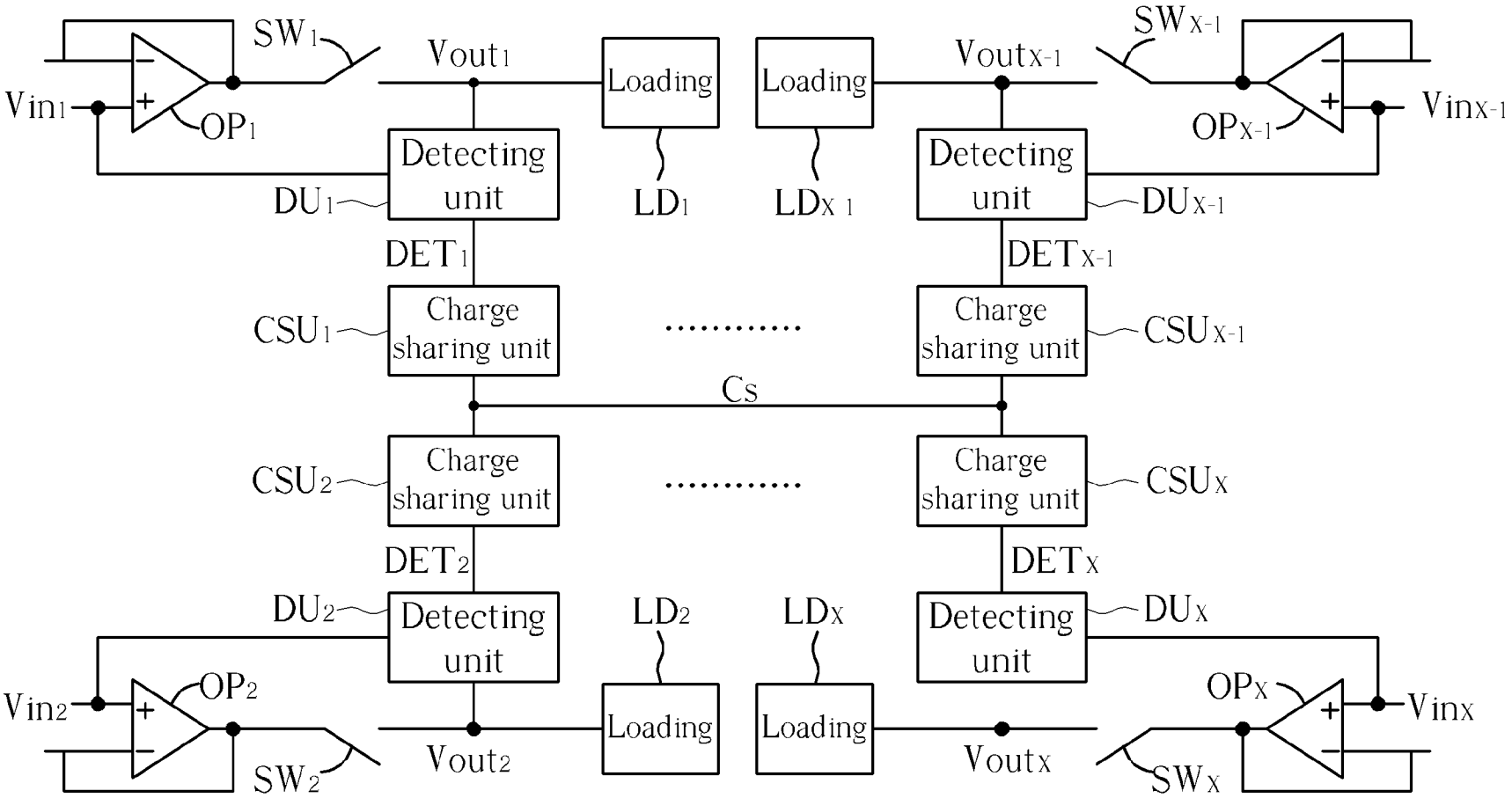
FIG. 6 is a schematic diagram of a liquid crystal display device according to an embodiment of the present invention.

In detail, Please refer to FIG. 6. FIG. 6 is a schematic diagram of a liquid crystal display device 60 according to an embodiment of the present invention. As shown in FIG. 6, the liquid crystal display device 60 includes operational amplifiers $OP_1$-$OP_x$, switches $SW_1$-$SW_x$, data lines $CH_1$-$CH_x$, loadings $LD_1$-$LD_x$, and a self-detection charge sharing module 600. The self-detection charge sharing module 600 includes detecting units $DU_1$-$DU_x$, charge sharing units $CSU_1$-$CSU_x$ and a common bus Cs. The liquid crystal display device 60 and the liquid crystal display device 30 are similar. Thus, elements and signals with similar function are denoted by the same symbols. Operations of the operational amplifiers $OP_3$-$OP_x$, the switches $SW_3$-$SW_x$, the data lines $CH_3$-$CH_x$, the loadings $LD_3$-$LD_x$ and the operational amplifiers $OP_1$-$OP_2$, the switches $SW_1$-$SW_2$, the data lines $CH_1$-$CH_2$, the loadings $LD_1$-$LD_2$ are substantially the same, and can be referred to the above description.

A main difference between the liquid crystal display device 60 and the liquid crystal display device 30 is that the detecting units $DU_1$-$DU_x$ detect the input voltages $Vin_1$-$Vin_x$ and the output voltages $Vout_1$-$Vout_x$ corresponding to the data lines $CH_1$-$CH_x$ respectively, to generate detecting results $DET_1$-$DET_x$ for the charge sharing units $CSU_1$-$CSU_x$, such that the charge sharing units $CSU_1$-$CSU_x$ conduct connections between at least one corresponding first data line, at least one corresponding second data line and the common bus Cs, to perform charge sharing when the detecting results $DET_1$-$DET_x$ indicate at least one first input voltage and at least one second input voltage among the input voltages $Vin_1$-$Vin_x$ have opposite voltage variation directions and vary toward each other. As a result, the present invention can share charges of loadings of at least two data lines of any two input voltages having opposite voltage variation direction and varying toward each other.

For example, when the input voltages $Vin_1$-$Vin_2$ vary as shown in FIG. 4 and another the input voltage $Vin_3$ has the same variation with the input voltage $Vin_1$, the charge sharing units $CSU_1$-$CSU_3$ conduct connections between the data lines $CH_1$-$CH_3$ and the common bus Cs, to share charges of the loadings $LD_1$, $LD_3$ with the loading $LD_2$. Please note that when a situation of input voltages shown in FIG. 4 having opposite polarities and varying toward the middle voltage VM and a situation of input voltages shown in FIG. 5 having a same polarity and varying toward different directions exist simultaneously, since charges are shared more under a situation of tendency of the input voltages Variation shown in FIG. 4, the charge sharing units $CSU_1$-$CSU_x$ can make data lines with tendency of the input voltages Variation shown in FIG. 4 couple to the common bus Cs and perform charge sharing, to enhance more performance of power saving.

Figure 7:
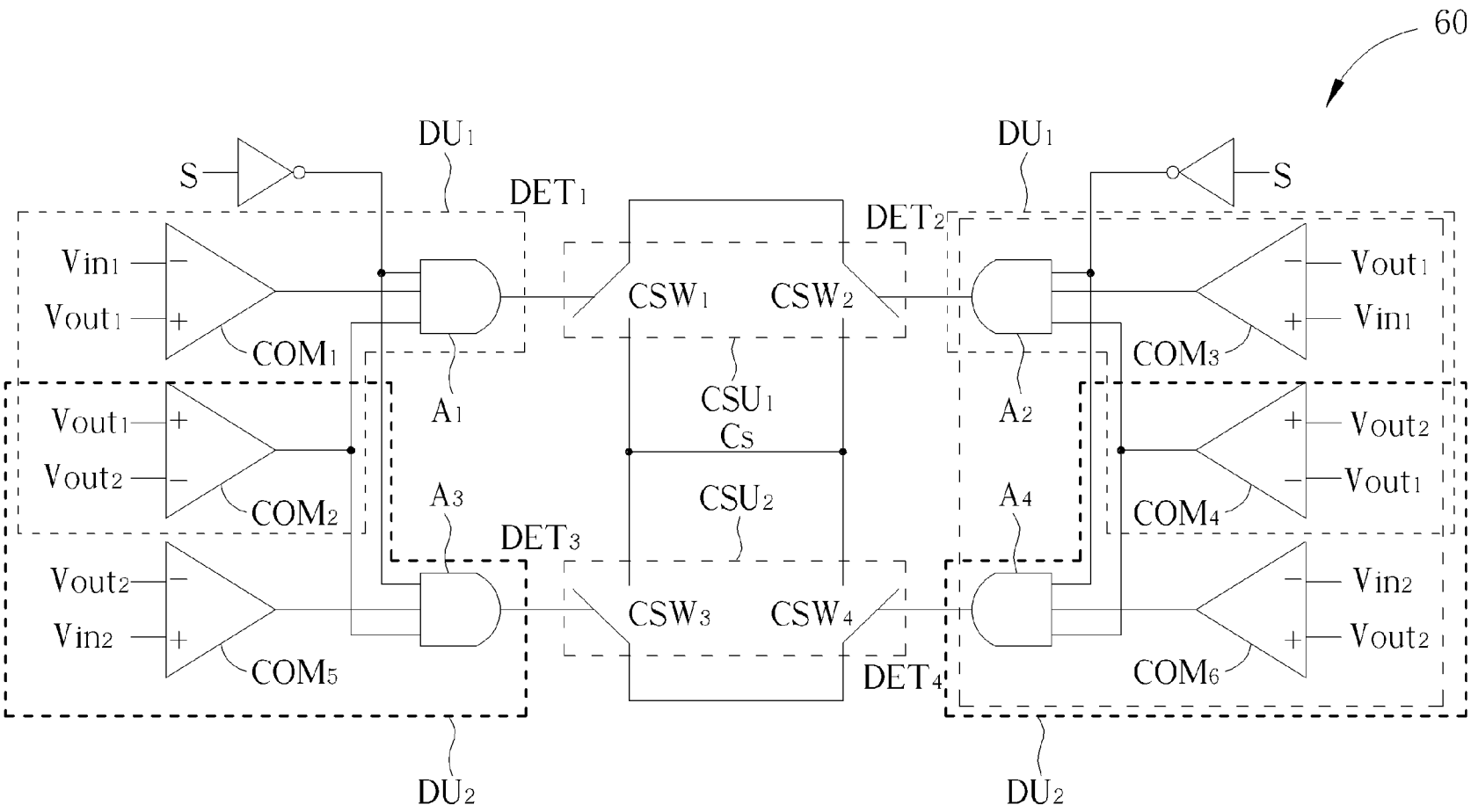
FIG. 7 is a detailed schematic diagram of two detecting units and two charge sharing units shown in FIG. 6.

Specifically, please refer to FIG. 7. FIG. 7 is a detailed schematic diagram of the detecting units $DU_1$-$DU_2$ and the charge sharing units $CSU_1$-$CSU_2$ shown in FIG. 6. As shown in FIG. 7, the detecting unit $DU_1$ includes comparators $COM_1$-$COM_4$ and AND gates $A_1$-$A_2$. The detecting unit $DU_2$ includes comparators $COM_2$, $COM_4$-$COM_6$ and AND gates $A_3$-$A_4$, wherein the detecting unit $DU_1$ and detecting unit $DU_2$ share the comparators $COM_2$, $COM_4$. The charge sharing unit $CSU_1$ includes charge sharing switches $CSW_1$-$CSW_2$, and the charge sharing unit $CSU_2$ comprises charge sharing switches $CSW_3$-$CSW_4$. As a structure shown in left part of FIG. 7, the comparator $COM_1$ includes a negative input terminal for receiving the input voltage $Vin_1$, and a positive input terminal for receiving the output voltage $Vout_1$. The comparator $COM_2$ includes a positive input terminal for receiving the output voltage $Vout_1$, and a negative input terminal for receiving the output voltage $Vout_2$. The comparator $COM_5$ includes a positive input terminal for receiving the input voltage $Vin_2$, and a negative input terminal for receiving the output voltage $Vout_2$. Input terminals of the AND gate $A_1$ are coupled to output terminals of the comparator $COM_1$ and the comparator $COM_2$ and an inverted signal of the control signal S. Input terminals of the AND gate $A_3$ are coupled to output terminals of and the comparator $COM_2$ and the comparator $COM_5$ and an inverted signal of the control signal S. The charge sharing switch $CSW_1$ conducts a connection between the output voltage $Vout_1$ and the common bus Cs (i.e. conducting a connection between the data lines $CH_1$ and the common bus Cs) according to the detecting result $DET_1$ of the AND gate $A_1$, and the charge sharing switch $CSW_3$ conducts a connection between the output voltage $Vout_2$ and the common bus Cs (i.e. conducting a connection between the data lines $CH_2$ and the common bus Cs) according to a detecting result $DET_3$ of the AND gate $A_3$.

Under such a structure, the detecting results $DET_1$, $DET_3$ of the AND gates $A_1$, $A_3$ are high voltage level to control the charge sharing switches $CSW_1$, $CSW_3$ to conduct connections between the output voltages $Vout_1$, $Vout_2$ and the common bus Cs, to perform charge sharing when the output voltage $Vout_1$ is greater than the input voltage $Vin_1$ (vary toward negative direction), the output voltage $Vout_2$ is less than the input voltages $Vin_2$ (vary toward positive direction), the output voltage $Vout_1$ is greater than the output voltage $Vout_2$ (the input voltage $Vin_1$ and the input voltage $Vin_2$ vary toward to each other or vary toward to each other and then reach target voltage levels) and the control signal S are low voltage level to control the switches $SW_1$, $SW_2$ to disconnect the connections between the operational amplifiers $OP_1$, $OP_2$ and the data lines $CH_1$, $CH_2$.

Similarly, as a structure shown in right part of FIG. 7, the comparator $COM_3$ includes a negative input terminal for receiving the output voltage $Vout_1$, and a positive input terminal for receiving the input voltage $Vin_1$. The comparator $COM_4$ includes a positive input terminal for receiving the output voltage $Vout_2$, and a negative input terminal for receiving the output voltage $Vout_1$. The comparator $COM_6$ includes a positive input terminal for receiving the output voltage $Vout_2$, and a negative input terminal for receiving the input voltage $Vin_2$. Input terminals of the AND gate $A_2$ are coupled to output terminals of the comparator $COM_3$ and the comparator $COM_4$ and the inverted signal of the control signal S. Input terminals of the AND gate $A_4$ are coupled to output terminals of the comparator $COM_4$ and the comparator $COM_6$ and the inverted signal of the control signal S. The charge sharing switch $CSW_2$ conducts a connection between the output voltage $Vout_1$ and the common bus Cs according to the detecting result $DET_2$ of the AND gate $A_2$, and the charge sharing switch $CSW_4$ conducts a connection between the output voltage $Vout_2$ and the common bus Cs according to the detecting result $DET_4$ of the AND gate $A_4$.

Under such a structure, the detecting results $DET_2$, $DET_4$ of the AND gates $A_2$, $A_4$ are high voltage level to control the charge sharing switches $CSW_2$, $CSW_4$ to conduct connections between the output voltages $Vout_1$, $Vout_2$ and the common bus Cs, to perform charge sharing when the output voltage $Vout_1$ is less than the input voltage $Vin_1$ (vary toward positive direction), the output voltage $Vout_2$ is greater than the input voltage $Vin_2$ (vary toward negative direction), the output voltage $Vout_1$ is greater than the output voltage $Vout_2$ (the input voltage $Vin_1$ and the input voltage $Vin_2$ vary toward to each other or vary toward to each other and then reach target voltage levels), and the control signal S is low voltage level to control the switches $SW_1$, $SW_2$ to disconnect the connections between the operational amplifiers $OP_1$, $OP_2$ and the data lines $CH_1$, $CH_2$. In other words, the structures shown in left and right FIG. 7 are utilized for conducting connections under two different situations of the input voltage $Vin_1$ and the input voltage $Vin_2$ having opposite voltage variation directions and varying toward each other respectively. As a result, the present invention can detect input voltages and output voltages by utilizing structures of comparators, to couple loadings of data lines of any two groups of input voltages having opposite voltage variation direction and varying toward each other to the common bus Cs and perform charge sharing.

Figure 8:
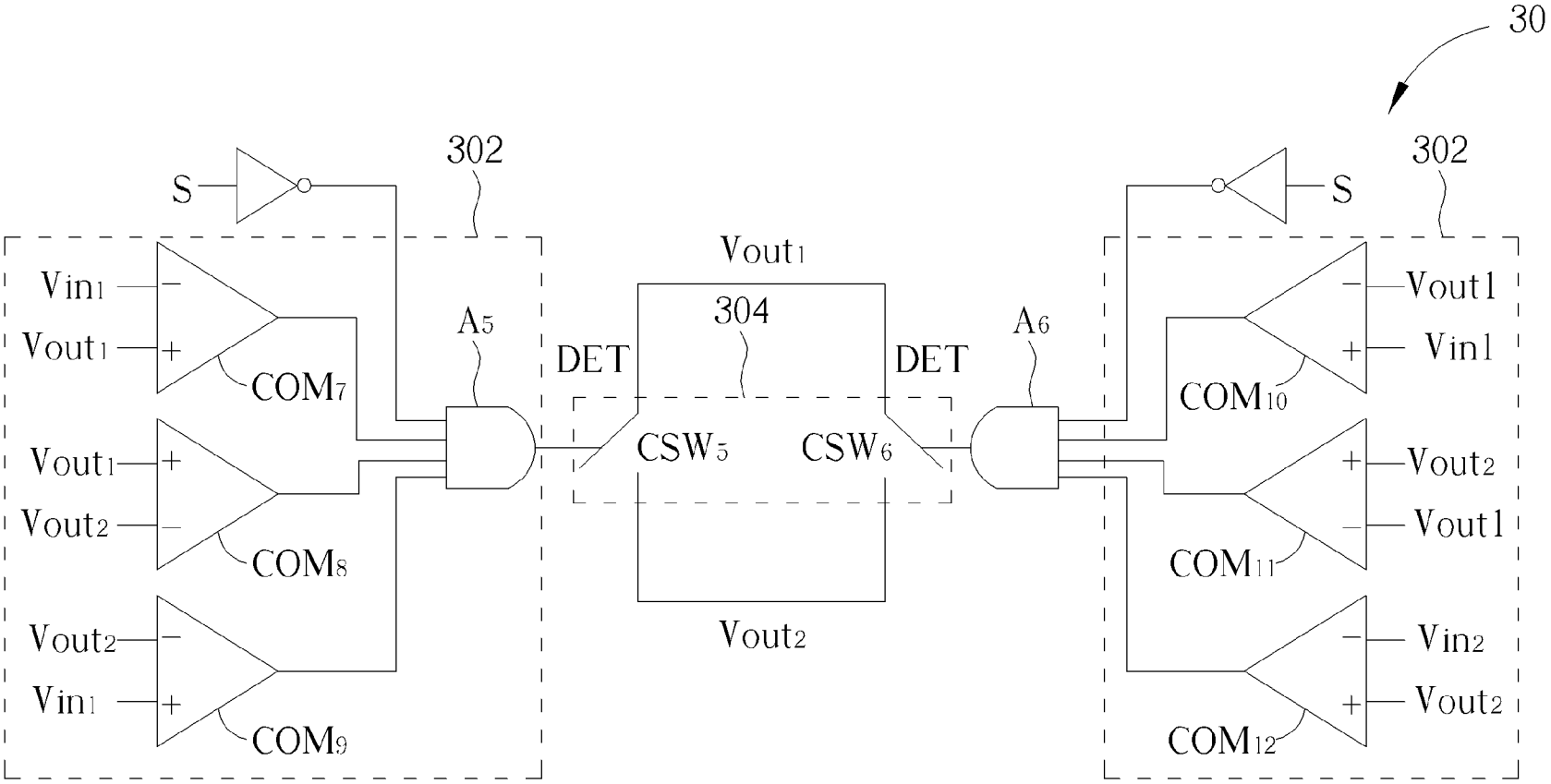
FIG. 8 is a detailed schematic diagram of a detecting unit and a charge sharing unit shown in FIG. 3.

On the other hand, please refer to FIG. 8. FIG. 8 is a detailed schematic diagram of the detecting unit 302 and the charge sharing unit 304 shown in FIG. 3. As shown in FIG. 8, the detecting unit 302 includes comparators $COM_7$-$COM_{12}$ and AND gates $A_5$-$A_6$. The charge sharing unit 304 includes charge sharing switches $CSW_5$-$CSW_6$. As a structure shown in left FIG. 8, the comparator $COM_7$ includes a negative input terminal for receiving the input voltage $Vin_1$, and a positive input terminal for receiving the output voltage $Vout_1$. The comparator $COM_8$ includes a positive input terminal for receiving the output voltage $Vout_1$, and a negative input terminal for receiving the output voltage $Vout_2$. The comparator $COM_9$ includes a positive input terminal for receiving the input voltage $Vin_2$, and a negative input terminal for receiving the output voltage $Vout_2$. Input terminals of the AND gate $A_5$ are coupled to output terminals of the comparator $COM_7$, the comparator $COM_8$ and the comparator $COM_9$ and the inverted signal of the control signal S. The charge sharing switches $CSW_5$ conducts a connection between the output voltage $Vout_1$ and the output voltage $Vout_2$ (i.e. conducts the connection between the data lines $CH_1$ and $CH_2$) according to the detecting result DET of the AND gate $A_5$.

Under such a structure, the detecting result DET of the AND gate $A_5$ is high voltage level to control the charge sharing switches $CSW_5$ to conduct a connection between the output voltages $Vout_1$ and $Vout_2$, to perform charge sharing when the output voltage $Vout_1$ is greater than the input voltage $Vin_1$ (vary toward negative direction), the output voltage $Vout_2$ is less than the input voltage $Vin_2$ (vary toward positive direction), the output voltage $Vout_1$ is greater than the output voltage $Vout_2$ (the input voltage $Vin_1$ and the input voltage $Vin_2$ vary toward to each other or vary toward to each other and then reach target voltage levels) and the control signal S are low voltage level to control the switches $SW_1$, $SW_2$ to disconnect the connections between the operational amplifiers $OP_1$, $OP_2$ and the data lines $CH_1$, $CH_2$.

Similarly, as a structure shown in right part of FIG. 8, the comparator $COM_{10}$ includes a negative input terminal for receiving the output voltage $Vout_1$, and a positive input terminal for receiving the input voltage $Vin_1$. The comparator $COM_{11}$ includes a positive input terminal for receiving the output voltage $Vout_2$, and a negative input terminal for receiving the output voltage $Vout_1$. The comparator $COM_{12}$ includes a positive input terminal for receiving the output voltage $Vout_2$, and a negative input terminal for receiving the input voltage $Vin_2$. Input terminals of the AND gate $A_6$ are coupled to output terminals of the comparators $COM_{10}$, $COM_{11}$, $COM_{12}$ and the inverted signal of the control signal S. The charge sharing switch $CSW_6$ conducts the connection between the output voltage $Vout_1$ and the output voltage $Vout_2$ according to the detecting result DET of the AND gate $A_6$.

Under such a structure, the detecting result DET of the AND gate $A_6$ is high voltage level to control the charge sharing switches $CSW_6$ to conduct connections between the output voltages $Vout_1$ and $Vout_2$, to perform charge sharing when the output voltage $Vout_1$ is less than the input voltage $Vin_1$ (vary toward positive direction), the output voltage $Vout_2$ is greater than the input voltage $Vin_2$ (vary toward negative direction), the output voltage $Vout_1$ is greater than the output voltage $Vout_2$ (the input voltage $Vin_t$ and the input voltage $Vin_2$ vary toward to each other or vary toward to each other and then reach target voltage levels), and the control signal S is low voltage level to control the switches $SW_1$, $SW_2$ to disconnect the connections between the operational amplifiers $OP_1$, $OP_2$ and the data lines $CH_1$, $CH_2$. In other words, the structures shown in left part and right part of FIG. 8 are utilized for conducting connections under different situations of the input voltage $Vin_1$ and the input voltage $Vin_2$ having opposite voltage variation direction and varying toward each other respectively. As a result, the present invention can detect input voltages and output voltages by utilizing comparator structures, to share charges of loadings of data lines of any two groups of input voltages having opposite voltage variation direction and varying toward each other.

Figure 9:
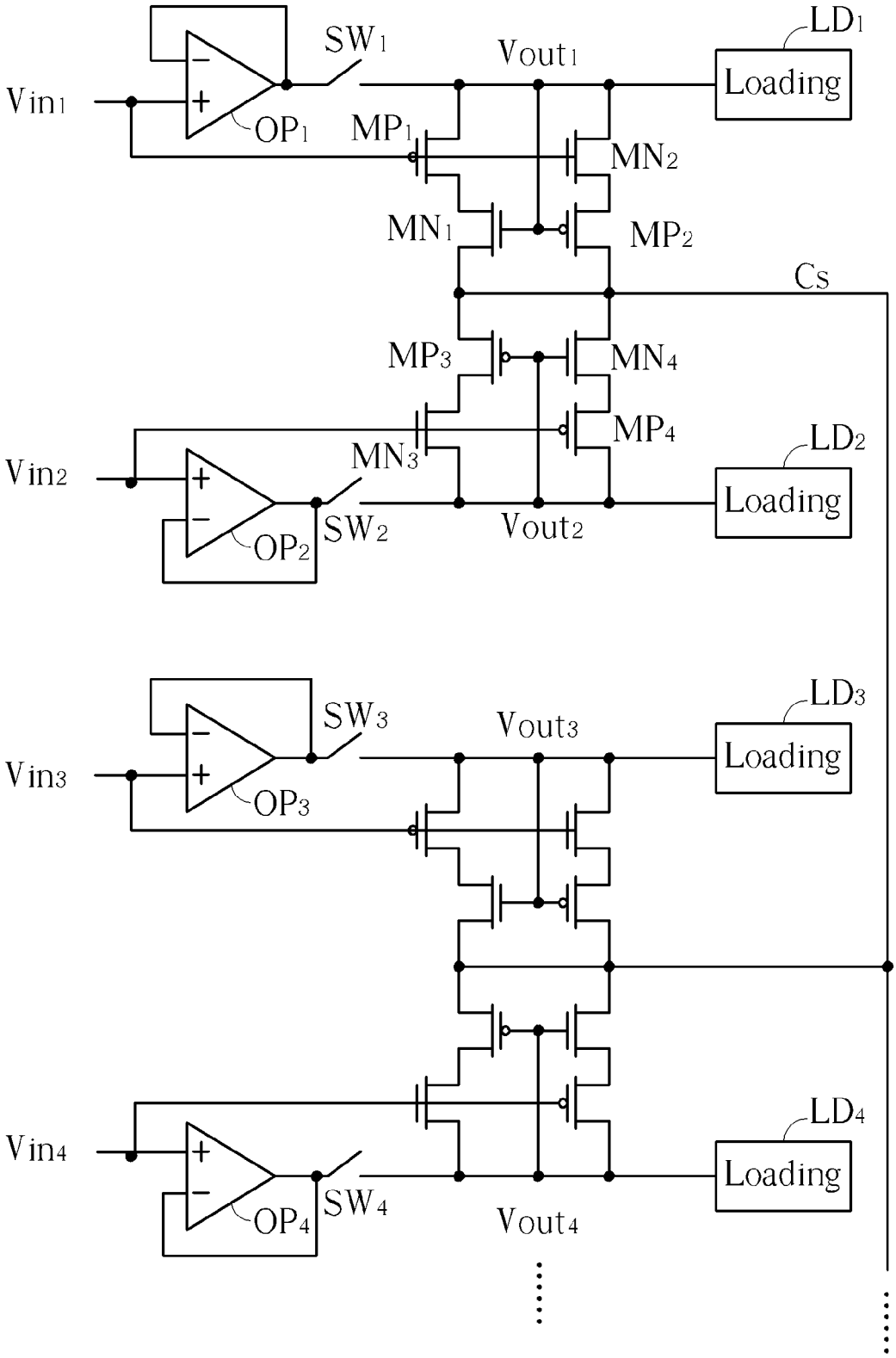
FIG. 9 is another detailed schematic diagram of four detecting units and four charge sharing units shown in FIG. 6.

In addition, please refer to FIG. 9. FIG. 9 is another detailed schematic diagram of the detecting units $DU_1$-$DU_4$ and the charge sharing units $CSU_1$-$CSU_4$ shown in FIG. 6. As shown in FIG. 9, the detecting unit $DU_1$ and the charge sharing unit $CSU_1$ share transistors $MP_1$-$MP_2$, $MN_1$-$MN_2$. The detecting unit $DU_2$ the charge sharing unit $CSU_2$ share transistors $MP_3$-$MP_4$, $MN_3$-$MN_4$, wherein the transistors $MP_1$-$MP_4$ are P-type metal oxide semiconductor field-effect transistors (MOSFETs), and the transistors $MN_1$-$MN_4$ are N-type MOSFETs. As a structure shown in left part of FIG. 9, a gate of the transistor $MP_1$ is coupled to the input voltage $Vin_1$, and a source of the transistor $MP_1$ is coupled to the output voltage $Vout_1$. A gate of the transistor $MN_1$ is coupled to the output voltage $Vout_1$, and a source and a drain of the transistor $MN_1$ are coupled to the common bus Cs and a source of the transistor $MP_1$ respectively. A gate of the transistor $MN_3$ is coupled to the input voltage $Vin_2$, and a source of the transistor $MN_3$ is coupled to the output voltage $Vout_2$. A gate of the transistor $MP_3$ is coupled to the output voltage $Vout_2$, and a source and a drain of the transistor $MP_3$ are coupled to the common bus Cs and a drain of the transistor $MN_3$ respectively (the gate, the source and the drain can be seen as a control terminal, a first terminal and a second terminal).

Under such a structure, the transistors $MP_1$, $MN_1$, $MN_3$, $MP_3$ conduct connections between the output voltage $Vout_1$, $Vout_2$ and the common bus Cs (i.e. conduct the connections between the data lines $CH_1$, $CH_2$ and the common bus Cs), to perform charge sharing when the output voltage $Vout_1$ minus a threshold voltage Vt is greater than the input voltage $Vin_1$ (i.e. $Vout_1-Vt>Vin_1$, vary toward negative direction), the output voltage $Vout_2$ is less than the input voltage $Vin_2$ minus the threshold voltage Vt (i.e. $Vin_2-Vt>Vout_2$, vary toward positive direction), the output voltage $Vout_1$ minus the threshold voltage Vt is greater than a common voltage VcomVcs of the common bus Cs, and the output voltage $Vout_2$ is less than the common voltage VcomVcs minus the threshold voltage Vt (i.e. $Vout_1-Vt>Vcs$ and $Vcs-Vt>Vout_2$, the input voltage $Vin_1$ and the input voltage $Vin_2$ vary toward to each other or vary toward to each and then reach target voltage levels), and the transistors $MP_3$, $MN_1$ are turned off to stop charge sharing when the differences between the output voltages $Vout_1$, $Vout_2$ and the common voltage VcomVcs are less than the threshold voltage Vt.

Similarly, as a structure shown in right part of FIG. 9, a gate of the transistor $MN_2$ is coupled to the input voltage $Vin_1$, and a source of the transistor $MN_2$ is coupled to the output voltage $Vout_1$. A gate of the transistor $MP_2$ is coupled to the output voltage $Vout_1$, and a source and a drain of the transistor $MN_1$ are coupled to the common bus Cs and a drain of the transistor $MN_2$ respectively. A gate of the transistor $MN_4$ is coupled to the output voltage $Vout_2$, and a source and a drain of the transistor $MN_4$ are coupled to the common bus Cs and a drain of the transistor $MP_4$ respectively (the gate, the source and the drain can be seen as a control terminal, a first terminal and a second terminal).

Under such a structure, the transistors $MN_2$, $MP_2$, $MP_4$, $MN_4$ conduct connections between the output voltages $Vout_1$, $Vout_2$ and the common bus Cs (i.e. conduct the connections between the data lines $CH_1$, $CH_2$ and the common bus Cs), to perform charge sharing when the input voltage $Vin_1$ minus a threshold voltage Vt is greater than the output voltage $Vout_1$ (i.e. $Vin_1-Vt>Vout_1$, vary toward positive direction), the output voltage $Vout_2$ minus the threshold voltage Vt is greater than the input voltage $Vin_2$ (i.e. $Vout_2-Vt>Vin_2$, vary toward negative direction), the common voltage VcomVcs minus the threshold voltage Vt is greater than the output voltage $Vout_1$, and the output voltage $Vout_2$ minus the threshold voltage Vt is greater than the common voltage VcomVcs (i.e. $Vout_1-Vt>Vcs$ and $Vcs-Vt>Vout_2$, the input voltage $Vin_1$ and the input voltage $Vin_2$ vary toward to each other or vary toward to each and then reach target voltage levels), and the transistors $MP_2$, $MN_4$ are turned off to stop charge sharing when the differences between the output voltages $Vout_1$, $Vout_2$ and the common voltage VcomVcs are less than the threshold voltage Vt. In other words, the structures shown in left part and right part of FIG. 9 are utilized for conducting connections under different situations of the input voltage $Vin_1$ and the input voltage $Vin_2$ having opposite voltage variation direction and varying toward each other respectively.

In the same way, the detecting units $DU_3$-$DU_x$ and charge sharing units $CSU_3$-$CSU_x$ can be realized by similar structures with the detecting units $DU_1$-$DU_2$ and the charge sharing units $CSU_1$-$CSU_2$, and thus the detecting units $DU_3$-$DU_x$ and charge sharing units $CSU_3$-$CSU_x$ can perform detection by itself dynamically and independently to decide whether to perform charge sharing and stop by itself without any control signals. As a result, the present invention can detect input voltages and output voltages by utilizing structures of transistor switches, to share charges of loadings of at lease one data line of any two groups of input voltages having opposite voltage variation direction and varying toward each other.

Figure 10:
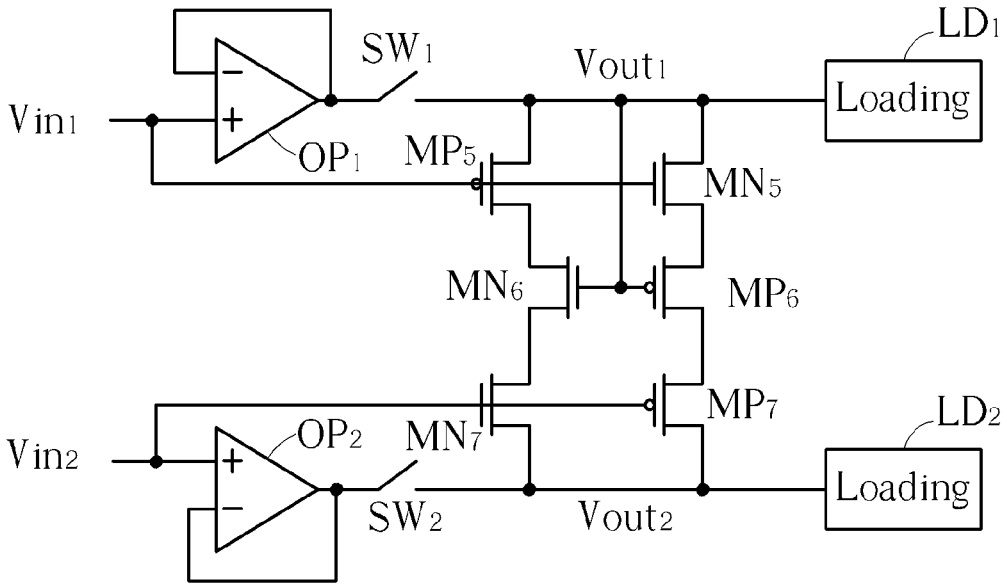
FIG. 10 is a detailed schematic diagram of the detecting unit and the charge sharing unit shown in FIG. 3.

Moreover, please refer to FIG. 10. FIG. 10 is a detailed schematic diagram of the detecting unit 302 and the charge sharing unit 304 shown in FIG. 3. As shown in FIG. 10, the detecting unit 302 and the charge sharing unit 304 jointly comprise transistors $MP_5$-$MP_7$, $MN_5$-$MN_7$, wherein the transistors $MP_5$-$MP_7$ are P-type MOSFETs, and the transistors $MN_5$-$MN_7$ are N-type MOSFETs. As a structure shown in left part of FIG. 10, a gate of the transistor $MP_5$ is coupled to the input voltage $Vin_1$, and a drain of the transistor $MP_5$ is coupled to the output voltage $Vout_1$. A gate of the transistor $MN_6$ is coupled to the output voltage $Vout_1$, and a drain of the transistor $MN_6$ is coupled to a drain of the transistor $MP_5$. A gate of the transistor $MN_6$ is coupled to the input voltage $Vin_2$, and a source of the transistor $MN_6$ is coupled to the output voltage $Vout_2$. A gate of the transistor $MP_7$ is coupled to the output voltage $Vout_2$, and a drain of the transistor $MP_7$ is coupled to a source of the transistor $MN_6$ respectively (the gate, the source and the drain can be seen as a control terminal, a first terminal and a second terminal).

Under such a structure, the transistors $MP_5$, $MN_6$, $MN_7$ conduct the connection between the output voltages $Vout_1$ and $Vout_2$ (i.e. conduct the connection between the data lines $CH_1$ and $CH_2$), to perform charge sharing when the output voltage $Vout_1$ minus the threshold voltage Vt is greater than the input voltage $Vin_1$ (i.e. $Vout_1-Vt>Vin_1$, vary toward negative direction), the output voltage $Vout_2$ is less than the input voltage $Vin_2$ minus the threshold voltage Vt (i.e. $Vin_2-Vt>Vout_2$, vary toward positive direction), the output voltage $Vout_1$ minus the threshold voltage Vt is greater than the output voltage $Vout_2$ (i.e. $Vout_1-Vt>Vout_2$, the input voltage $Vin_1$ and the input voltage $Vin_2$ vary toward to each other or vary toward to each and then reach target voltage levels), and the transistors $MN_6$ is turned off to stop charge sharing when the difference between the output voltages $Vout_1$ and $Vout_2$ is less than the threshold voltage Vt.

Similarly, as a structure shown in right part of FIG. 10, a gate of the transistor $MN_5$ is coupled to the input voltage $Vin_1$, and a source of the transistor $MN_5$ is coupled to the output voltage $Vout_1$. A gate of the transistor $MP_6$ is coupled to the output voltage $Vout_1$. A gate of the transistor $MN_7$ is coupled to the input voltage $Vin_2$, and a source and a drain of the transistor $MP_7$ are coupled to the output voltage $Vout_2$ and a source of the transistor $MP_6$ respectively (the gate, the source and the drain can be seen as a control terminal, a first terminal and a second terminal).

Under such a structure, the transistors $MN_5$, $MP_6$, $MP_7$ conduct the connection between the output voltages $Vout_1$ and $Vout_2$ (i.e. conduct the connection between the data lines $CH_1$ and $CH_2$), to perform charge sharing when the input voltage $Vin_1$ minus a threshold voltage Vt is greater than the output voltage $Vout_1$ (i.e. $Vin_1-Vt>Vout_1$, vary toward positive direction), the output voltage $Vout_2$ minus the threshold voltage Vt is greater than the input voltage $Vin_2$ (i.e. $Vout_2-Vt>Vin_2$, vary toward negative direction), and the output voltage $Vout_2$ minus the threshold voltage Vt is greater than the output voltage $Vout_1$ (i.e. $Vout_2-Vt>Vout_1$, the input voltage $Vin_1$ and the input voltage $Vin_2$ vary toward to each other or vary toward to each and then reach target voltage levels), and the transistors $MP_6$ is turned off to stop charge sharing when the differences between the output voltages $Vout_1$ and $Vout_2$ is less than the threshold voltage Vt. In other words, the structures shown in left and right part of FIG. 10 are utilized for conducting connections under different situations of the input voltage $Vin_1$ and the input voltage $Vin_2$ having opposite voltage variation direction and varying toward each other respectively. As a result, the present invention can detect input voltages and output voltages by utilizing structures of switching transistors, to share charges of loadings of at lease one data line of any two groups of input voltages having opposite voltage variation direction and varying toward each other.

Figure 11:
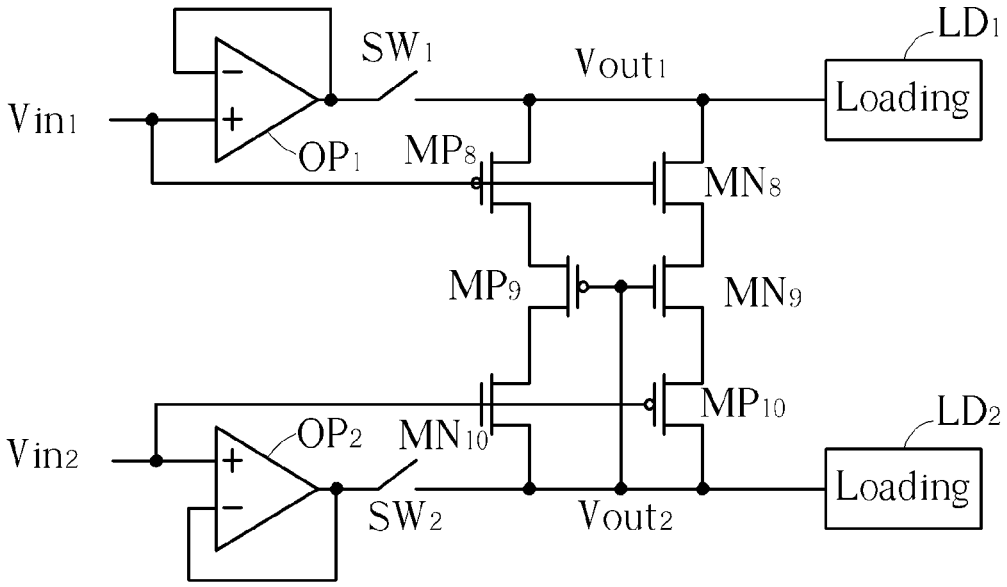
FIG. 11 is a detailed schematic diagram of the detecting unit and the charge sharing unit shown in FIG. 3.

In addition, please refer to FIG. 11. FIG. 11 is a detailed schematic diagram of the detecting unit 302 and the charge sharing unit 304 shown in FIG. 3. As shown in FIG. 11, the detecting unit 302 and the charge sharing unit 304 jointly comprise transistors $MP_8$-$MP_{10}$, $MN_8$-$MN_{10}$, wherein the transistors $MP_8$-$MP_{10}$ are P-type MOSFETs, and the transistors $MN_8$-$MN_{10}$ are N-type MOSFETs. As a structure shown in left part of FIG. 11, a gate of the transistor $MP_8$ is coupled to the input voltage $Vin_1$, and a source of the transistor $MP_8$ is coupled to the output voltage $Vout_1$. A gate of the transistor $MP_9$ is coupled to the output voltage $Vout_1$, and a source of the transistor $MP_9$ is coupled to a drain of the transistor $MP_8$. A gate of the transistor $MN_{10}$ is coupled to the input voltage $Vin_2$, and a source and a drain of the transistor $MN_{10}$ are coupled to the output voltage $Vout_2$ and a drain of the transistor $MP_9$ respectively (the gate, the source and the drain can be seen as a control terminal, a first terminal and a second terminal).

Under such a structure, the transistors $MP_8$, $MP_9$, $MN_{10}$ conduct the connection between the output voltages $Vout_1$ and $Vout_2$ (i.e. conduct the connection between the data lines $CH_1$ and $CH_2$), to perform charge sharing when the output voltage $Vout_1$ minus the threshold voltage Vt is greater than the input voltage $Vin_1$ (i.e. $Vout_1-Vt>Vin_1$, vary toward negative direction), the output voltage $Vout_2$ is less than the input voltage $Vin_2$ minus the threshold voltage Vt (i.e. $Vin_2-Vt>Vout_2$, vary toward positive direction), and the output voltage $Vout_1$ minus the threshold voltage Vt is greater than the output voltage $Vout_2$ (i.e. $Vout_1-Vt>Vout_2$, the input voltage $Vin_1$ and the input voltage $Vin_2$ vary toward to each other or vary toward to each and then reach target voltage levels), and the transistors $MP_9$ is turned off to stop charge sharing when the difference between the output voltages $Vout_1$ and $Vout_2$ is less than the threshold voltage Vt.

Similarly, as a structure shown in right FIG. 11, a gate of the transistor $MN_8$ is coupled to the input voltage $Vin_1$, and a source of the transistor $MN_8$ is coupled to the output voltage $Vout_1$. A gate of the transistor $MN_9$ is coupled to the output voltage $Vout_1$ and a source of the transistor $MN_9$ is coupled to a drain of the transistor $MN_8$. A gate of the transistor $MP_{10}$ is coupled to the input voltage $Vin_2$, and a source and a drain of the transistor $MP_{10}$ are coupled to the output voltage $Vout_2$ and a drain of the transistor $MN_9$ respectively (the gate, the source and the drain can be seen as a control terminal, a first terminal and a second terminal).

Under such a structure, the transistors $MN_8$, $MN_9$, $MP_{10}$ conduct the connection between the output voltages $Vout_1$ and $Vout_2$ (i.e. conduct the connection between the data lines $CH_1$ and $CH_2$), to perform charge sharing when the input voltage $Vin_1$ minus a threshold voltage Vt is greater than the output voltage $Vout_1$ (i.e. $Vin_1-Vt>Vout_1$, vary toward positive direction), the output voltage $Vout_2$ minus the threshold voltage Vt is greater than the input voltage $Vin_2$ (i.e. $Vout_2-Vt>Vin_2$, vary toward negative direction), and the output voltage $Vout_2$ minus the threshold voltage Vt is greater than the output voltage $Vout_1$ (i.e. $Vout_2-Vt>Vout_1$, the input voltage $Vin_1$ and the input voltage $Vin_2$ vary toward to each other or vary toward to each and then reach target voltage levels), and the transistors $MN_9$ is turned off to stop charge sharing when the differences between the output voltages $Vout_1$ and $Vout_2$ is less than the threshold voltage Vt. In other words, the structures shown in left part and right part of FIG. 11 are utilized for conducting connections under different situations of the input voltage $Vin_1$ and the input voltage $Vin_2$ having opposite voltage variation direction and varying toward each other respectively (The main difference between structures shown in FIG. 11 and FIG. 10 is the transistors $MP_9$, $MN_9$ in FIG. 11 and the transistors $MN_6$, $MP_6$ of corresponding location in FIG. 10 are different types and the gates of the transistors $MP_9$, $MN_9$ are coupled to the output voltage $Vout_2$ but the output voltage $Vout_1$). As a result, the present invention can detect input voltages and output voltages by utilizing structures of switching transistors, to share charges of loadings of at lease one data line of any two groups of input voltages having opposite voltage variation direction and varying toward each other.

Please note that the detecting units $DU_1$-$DU_x$ and the charge sharing units $CSU_1$-$CSU_x$ are realized by MOSFETS to detect voltages and control switches in the embodiments shown in FIGS. 9 to 11. However, in other embodiments, the detecting units $DU_1$-$DU_x$ and the charge sharing units $CSU_1$-$CSU_x$ may realize by bipolar junction transistors (BJT), junction field effect transistors (JFET) or elements operated as switches, and the threshold voltage Vt may be 0V when different elements are applied.

In the prior art, conventional charge sharing techniques utilize digital signals (i.e. polarity inverted signals) to control data lines with opposite polarities of voltage to perform charge sharing for power saving when polarities of voltage change. These methods of charge sharing can save power only when polarities of voltages are inverted and thus can not apply to applications of only changing magnitudes of voltages but polarities of voltages, to perform charge sharing for saving power. In comparison, the present invention can detect tendency of voltage variation of data lines by itself and perform charge sharing when polarities of the input voltages are inverted, or the input voltages change and still maintain same polarities, to raise performance of power saving.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A self-detection charge sharing module, for a liquid crystal display device, comprising:

at least one detecting unit, for detecting a plurality of input voltages of a plurality of operational amplifiers driving a plurality of data lines and a plurality of output voltages of the plurality of data lines, to generate a plurality of detecting results; and at least one charge sharing unit, for conducting connection between at least one corresponding first data line and at least one corresponding second data line among the plurality of data line when the plurality of detecting results indicate at least one first input voltage and at least one second input voltage among the plurality of input voltage have opposite voltage variation directions and vary toward each other;

wherein the at least one first input voltage and the at least one second input voltage maintain respective polarities.

2. The self-detection charge sharing module of claim 1, wherein at least one first switch and at least one second switch disconnect connection between at least one corresponding first operational amplifier and the at least one first data line and connection between at least one corresponding second operational amplifier and the at least one second data line according to a control signal.

3. The self-detection charge sharing module of claim 1, wherein the at least one first input voltage and the at least one second input voltage have opposite polarities and voltage variation directions of the at least one first input voltage and the at least one second the input voltage Vary toward a middle voltage.

4. The self-detection charge sharing module of claim 1, wherein the at least one first input voltage and the at least one second input voltage have a same polarity and the at least one first input voltage and the at least one second input voltage have opposite voltage variation directions.

5. The self-detection charge sharing module of claim 1, further comprising a common bus, coupled to the at least one charge sharing unit, wherein the at least one charge sharing unit conducts connection between the at least one corresponding first data line, the at least one corresponding second data line, and the common bus when the plurality of detecting results indicate the at least one first input voltage and the at least one second input voltage have opposite voltage variation directions and vary toward each other.

6. The self-detection charge sharing module of claim 5, wherein a detecting unit among the at least one detecting unit comprises:

a first comparator, comprising a negative input terminal for receiving a specific voltage of the at least one first input voltage, and a positive input terminal for receiving a corresponding first output voltage;

a second comparator, comprising a positive input terminal for receiving the first output voltage, and a negative input terminal for receiving a second output voltage corresponding to one of the at least one second input voltage; and a first AND gate, comprising an input terminal coupled to output terminals of the first comparator and the second comparator and an inverted signal of a control signal.

7. The self-detection charge sharing module of claim 6, wherein a charge sharing unit among the at least one charge sharing unit comprises a first charge sharing switch for conducting connection between the first output voltage and the common bus according to a first detecting result of the first AND gate.

8. The self-detection charge sharing module of claim 6, wherein the detecting unit among the at least one detecting unit further comprises:

a third comparator, comprising a negative input terminal for receiving the first input voltage, and a positive input terminal for receiving the specific voltage of the at least one first input voltage;

a fourth comparator, comprising a positive input terminal for receiving the second output voltage, and a negative input terminal for receiving the first input voltage; and a second AND gate, comprising an input terminal coupled to output terminals of the third comparator and the fourth comparator and the inverted signal of the control signal.

9. The self-detection charge sharing module of claim 8, wherein the charge sharing unit among the at least one charge sharing unit further comprises a second charge sharing switch for conducting connection between the first output voltage and the common bus according to a second detecting result of the second AND gate.

10. The self-detection charge sharing module of claim 1, wherein a detecting unit among the at least one detecting unit comprises:

a fifth comparator, comprising a negative input terminal for receiving a first specific voltage of the at least one first input voltage, and a positive input terminal for receiving a corresponding first output voltage;

a sixth comparator, comprising a positive input terminal for receiving a second specific voltage of the at least one second input voltage, and a negative input terminal for receiving a corresponding second output voltage;

a seventh comparator, comprising a positive input terminal for receiving the first output voltage, and a negative input terminal for receiving the second output voltage; and a third AND gate, comprising an input terminal coupled to output terminals of the fifth comparator, the sixth comparator, and the seventh comparator and an inverted signal of a control signal.

11. The self-detection charge sharing module of claim 10, wherein a charge sharing unit among the at least one charge sharing unit comprises a third charge sharing switch for conducting connection between the first output voltage and the second output voltage according to a third detecting result of the third AND gate.

12. The self-detection charge sharing module of claim 10, wherein the detecting unit among the at least one detecting unit further comprises:

an eighth comparator, comprising a negative input terminal for receiving the first output voltage, and a positive input terminal for receiving the first specific voltage of the at least one first input voltage;

a ninth comparator, comprising a positive input terminal for receiving the second output voltage, and a negative input terminal for receiving the second specific voltage of the at least one second input voltage;

a tenth comparator, comprising a positive input terminal for receiving the second output voltage, and a negative input terminal for receiving the first output voltage; and a fourth AND gate, comprising an input terminal coupled to output terminals of the eighth comparator, the ninth comparator, and the tenth comparator and the inverted signal of the control signal.

13. The self-detection charge sharing module of claim 12, wherein the charge sharing unit among the at least one charge sharing unit comprises a forth charge sharing switch for conducting connection between the first output voltage and the second output voltage according to a fourth detecting result of the fourth AND gate.

14. The self-detection charge sharing module of claim 5, further comprising:

a first first-type transistor, comprising a control terminal coupled to one of the at least one first input voltage, and a first terminal coupled to a corresponding first output voltage;

a first second-type transistor, comprising a control terminal coupled to the first output voltage, a first terminal coupled to the common bus, and a second terminal coupled to a second terminal of the first first-type transistor;

a second second-type transistor, comprising a control terminal coupled to one of the at least one second input voltage, and a first terminal coupled to a corresponding second output voltage; and a second first-type transistor, comprising a control terminal coupled to the second output voltage, a first terminal coupled to the common bus, and a second terminal coupled to a second terminal of the second second-type transistor.

15. The self-detection charge sharing module of claim 14, wherein the first-type transistor is a P-type metal oxide semiconductor field-effect transistor, the second-type transistor is a N-type metal oxide semiconductor field-effect transistor, and the control terminal, the first terminal, and the second terminal are a gate, a source, and a drain respectively.

16. The self-detection charge sharing module of claim 14, wherein the first-type transistor is a N-type metal oxide semiconductor field-effect transistor, the second-type transistor is a P-type metal oxide semiconductor field-effect transistor, and the control terminal, the first terminal, and the second terminal are a gate, a source, and a drain respectively.

17. The self-detection charge sharing module of claim 1, further comprising:

a first first-type transistor, comprising a control terminal coupled to one of the at least one first input voltage, and a first terminal coupled to a corresponding first output voltage;

a first second-type transistor, comprising a control terminal coupled to the first output voltage, and a second terminal coupled to a second terminal of the first first-type transistor; and a second second-type transistor, comprising a control terminal coupled to one of the at least one second input voltage, a first terminal coupled to a corresponding second output voltage, and a second terminal coupled to a first terminal of the first second-type transistor.

18. The self-detection charge sharing module of claim 17, wherein the first-type transistor is a P-type metal oxide semiconductor field-effect transistor, the second-type transistor is a N-type metal oxide semiconductor field-effect transistor, and the control terminal, the first terminal, and the second terminal are a gate, a source, and a drain respectively.

19. The self-detection charge sharing module of claim 17, wherein the first-type transistor is a N-type metal oxide semiconductor field-effect transistor, the second-type transistor is a P-type metal oxide semiconductor field-effect transistor, and the control terminal, the first terminal, and the second terminal are a gate, a source, and a drain respectively.

20. The self-detection charge sharing module of claim 1, further comprising:

a first first-type transistor, comprising a control terminal coupled to one of the at least one first input voltage, and a first terminal coupled to a corresponding first output voltage;

a second first-type transistor, comprising a control terminal coupled to a corresponding second output voltage, and a first terminal coupled to a second terminal of the first first-type transistor; and a first second-type transistor, comprising a control terminal coupled to one of the at least one second input voltage, a first terminal coupled to the second output voltage, and a second terminal coupled to a second terminal of the second first-type transistor.

21. The self-detection charge sharing module of claim 20, wherein the first-type transistor is a P-type metal oxide semiconductor field-effect transistor, the second-type transistor is a N-type metal oxide semiconductor field-effect transistor, and the control terminal, the first terminal, and the second terminal are a gate, a source, and a drain respectively.

22. The self-detection charge sharing module of claim 20, wherein the first-type transistor is a N-type metal oxide semiconductor field-effect transistor, the second-type transistor is a P-type metal oxide semiconductor field-effect transistor, and the control terminal, the first terminal, and the second terminal are a gate, a source, and a drain respectively.

* * * * *